US006626728B2

(12) United States Patent
Holt

(10) Patent No.: US 6,626,728 B2
(45) Date of Patent: Sep. 30, 2003

(54) MOTION-SEQUENCE ACTIVATED TOY WAND

(75) Inventor: Kenneth Cooper Holt, Cazadero, CA (US)

(73) Assignee: Kenneth C. Holt, Cazadero, CA (US)

( * ) Notice: Subject to any disclaimer, the term of this patent is extended or adjusted under 35 U.S.C. 154(b) by 0 days.

(21) Appl. No.: 09/894,283

(22) Filed: Jun. 27, 2001

(65) Prior Publication Data

US 2002/0058459 A1 May 16, 2002

Related U.S. Application Data

(60) Provisional application No. 60/214,317, filed on Jun. 27, 2000.

(51) Int. Cl.[7] ..... A63H 33/22
(52) U.S. Cl. ..... 446/219; 446/175; 446/484
(58) Field of Search ..... 446/484, 485, 446/144, 175, 219, 421; 472/57, 61, 66; 362/102; 345/31; 40/452

(56) References Cited

U.S. PATENT DOCUMENTS 4,208,701 A * 6/1980 Schock ..... 362/102
4,231,077 A * 10/1980 Joyce et al. ..... 446/485
4,282,681 A * 8/1981 McCaslin ..... 446/484
4,678,450 A 7/1987 Scolari et al. ..... 446/405
4,891,032 A * 1/1990 Davis ..... 446/484
4,904,222 A 2/1990 Gastgeb et al. ..... 446/405
5,092,807 A * 3/1992 Lew et al. ..... 446/219
5,279,513 A * 1/1994 Connelly ..... 446/219
5,947,789 A * 9/1999 Chan ..... 446/219
6,150,947 A 11/2000 Shima ..... 340/692

* cited by examiner

*Primary Examiner*—Derris H. Banks
*Assistant Examiner*—Bena B. Morris

(57) ABSTRACT

The present invention is a toy wand that is activated and controlled by a sequence of motions of the wand while in the hand of an operator. When moved through a specific sequence of motions (herein termed a "spell", the wand will produce an appealing display of lights whose purpose is to amuse or entertain the wand operator or others in the viewing area. The toy wand comprises a casing, a means for detecting a sequence of motions, one or more lights, and a means for providing time-varying illumination from the lights as a function of the history of motions of the wand

15 Claims, 8 Drawing Sheets

SHEET 1

SHEET 2

SHEET 3

MOTION-SEQUENCE ACTIVATED TOY WAND

This Non-Provisional patent application References Provisional Application No. 60/214/317, filing date Jun. 27, 2000.

BACKGROUND OF THE INVENTION

Inventors and toy companies have been putting battery powered lights on sticks and toys since the first small batteries and lights made flashlights possible. (Hockenberry, U.S. Pat. No. 879,640 /1908)

Lighted wand or sword-like toys, at their most basic, use a light which is constantly on when the toy is in use. The entertaining visual value comes from waving the stick in a dark area, the persistence of vision of the eye making a connected, lit, line of illumination. Flowery patterned, lighted flexible ends have added value to this style of lighted wands (Davis, U.S. Pat. No. 4,891,032 /1990). Wands with fast blinking lights have been made possible by LED (light emitting diode) technology, creating more interesting illumination patterns. LEDs have also permitted the use of multiple colors. Integrated circuits have also brought sound to sword-like toys. Sound modules and transmitters have become miniaturized enough to include sound effects in toy swords, but not in wands.

Sensate Wand and Sword-like Toys

McCaslin (U.S. Pat. No. 4,282,681 /1981) describes a lighted wand that senses the electrical resistance of the hand holding the wand, and blinks the light at a corresponding speed.

An early attempt to couple motion-sensing to lighted sticks for toy purposes can be seen in Scolari (U.S. Pat. No. 4,678,450 /1987), where a strobe flash light is discharged into the translucent blade of a sword, actuated by an inertial switch. The switch is activated by the sword striking a hard object.

Motion-sensing grew more sophisticated in Shima (U.S. Pat. No. 6,150,947 /2000), in which an accelerometer is used to help sense the difference in strength between a shake and a strike of a toy sword. A differing sound is generated depending on the strength of the sensed motion. Gastgeb et al (U.S. Pat. No. 4,904,222) describes a toy sword whose motion is sensed by picking up the oscillatory signals from a bendable inertial element.

All of the prior art in sensate wand and sword toys has required an on/off switch to set the toy electronics inactive when not in use.

OBJECTIVES AND ADVANTAGES

It is important to note that none of the prior art of sensate wand or sword toys teaches performance that is more than an instantaneous reaction to a motion, acceleration, or other input.

In mythology and literature, wands are an implement of primary use in conjuring spells, such spells having a specific and mysterious invocation and a specific outcome or effect. Spells are usually conjured by verbal incantation and/or a specific motion of the wand.

A feeling of the power, mystery, magic and subtlety of traditional wand conjuring, presented in the form of an entertaining toy, is the objective of this invention.

It is therefore an object of the preset invention to provide a seemingly magical toy wand that is operated by performing "motion-spells"—precise sequences of wand motions, which result in entertaining light displays. The brilliant colored light displays are the effect, or reward of conjuring a spell correctly.

A further object of the present invention is to use a motion sensor, such as an accelerometer, and processing of its signal to allow a subtlety and complexity and array of spells and displays.

A further object of the present invention is to complement the subtlety and complexity of spells and displays with a magical-seeming construction of the wand, by making the wand's electronics and housing small, lightweight, sturdy, and sealed.

A further object of the present invention is to use lighting displays that are so unusual, bright and colorful that the displays themselves have a magical quality, independent of their means of generation.

A further object of the present invention is to control all aspects of wand operation purely by motion of the wand, without resorting to the use of switches, even to end play sessions. The magical feel of the wand is preserved and augmented by the avoidance of mundane mechanical and electrical contrivance. A (very long-lasting) sealed (or non-obvious) battery would also abet this objective.

A further objective is to provide very long battery life by use of the power-savings and "sleep" modes of modern microprocessors.

SUMMARY OF THE INVENTION

A toy wand has an elongated casing having a handle end and a tip end. The casing encloses a means for detecting motion of the wand, a means for emitting a human response and a microprocessor that connects the detector and the emitter. The microprocessor includes a library of target motion sequences, a time buffer for recording the motion history up to the present, and a means for repeatedly comparing the motion history with the target motion sequences. The microprocessor also includes a means for activating the emitting when a match has been detected between the motion history and the target motion sequence.

DETAILED DESCRIPTION OF THE INVENTION

Operation of the Wand

Summary of Operation of the Preferred Embodiment

Figure 1:
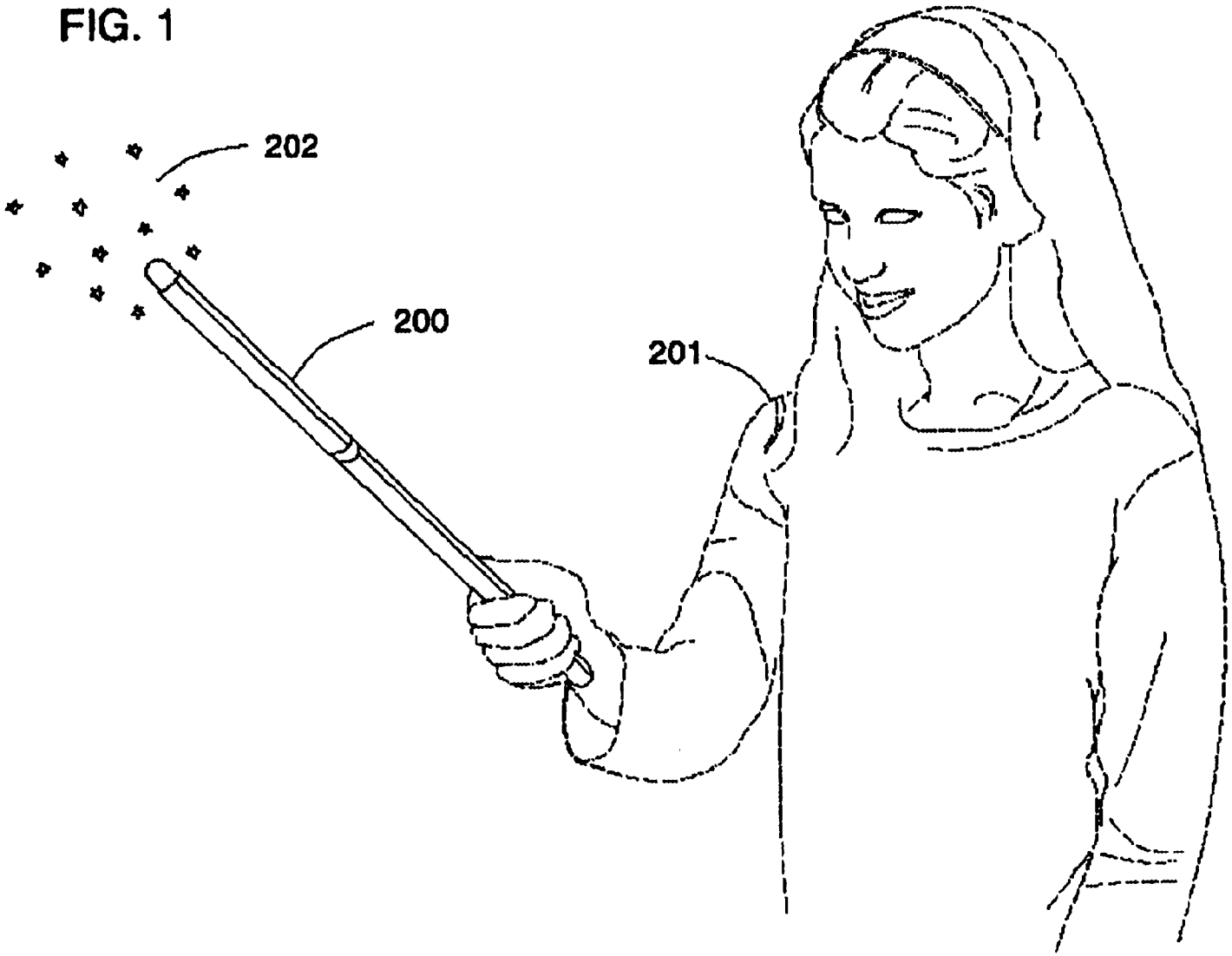
FIG. 1 is a perspective view of an inventive toy wand in the hand of an operator.

The wand (200) of the present invention in its preferred embodiment, is held by an operator (201), typically in one hand as shown in FIG. 1. The wand is then moved through a specific sequence of motions. When a specific sequence, i.e. a "spell", has been successfully performed, to tolerances set by the 'classify' and 'spell-decode' functions of the wand, the wand will recognize that fact and generate a unique pattern of light activity, herein called a "display". The wand can recognize many different spells, each of which has a different, specific sequence of motions. After a properly executed spell has triggered a display, the operator can then play with the display by moving the wand about and creating colored patterns and streaks of light, or the operator can just hold the wand while the display continues to light.

A unique display is generated for every spell that is decoded.

A display can be of 2 types; "Simple", and "Interactive":

A simple display executes a fixed pattern of blinking lights.

During an Interactive display the light patterns change instantly with changes in the direction of wand motion or with the speed of the wand.

The light activity will end, for some displays, by steadying the wand; in other displays it stops after a fixed time period.

Components of the Wand

Figure 3A:
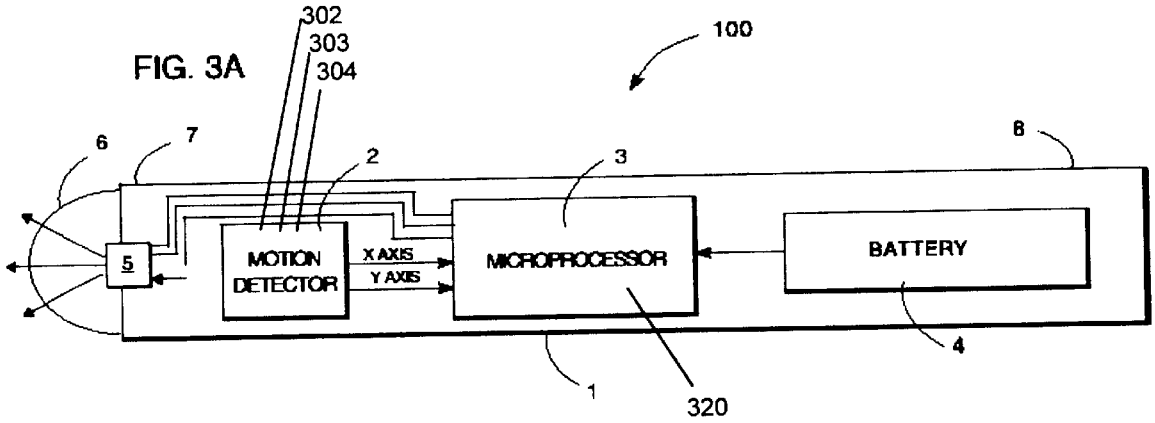
FIG. 3 is a block diagram showing the interconnectivity and the relative placement of the components of the toy wand of FIG. 1.
Figure 3B:
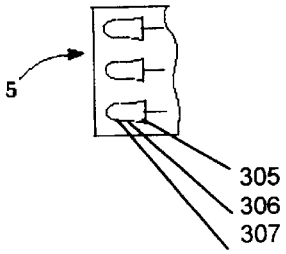

The components of the Wand(100), in the preferred embodiment, are shown in the Block(Connectivity) Diagram FIG. 3:

A Sturdy, Tubular Case (1) encloses electrical and electronic components:

- A Battery (4) such as Lithium 3.6V AA size, which mounted at the handle end of the wand(8) and is operably connected to
- A Microprocessor (3) such as Atmel AT2333, which is operably connected to one or more
- Colored LED Light Sources(5) such as Nichia NSP LED, which are mounted internally and are optically adjacent to a
- Light Transmitting Tip (endcap) (6), mounted at the tip end of the wand(7) and made of such material as acrylic plastic, glass, or crystal.
- A Motion Sensor (2) such as 2 axis accelerometer Analog Devices ADXL202, which is operably connected in each of its axis outputs by to the Microprocessor (3)

THEORY OF OPERATION

Preferred Embodiment

The Active Wand

In this preferred embodiment, a sequence of motions is used to decode spells.

Figure 5A:
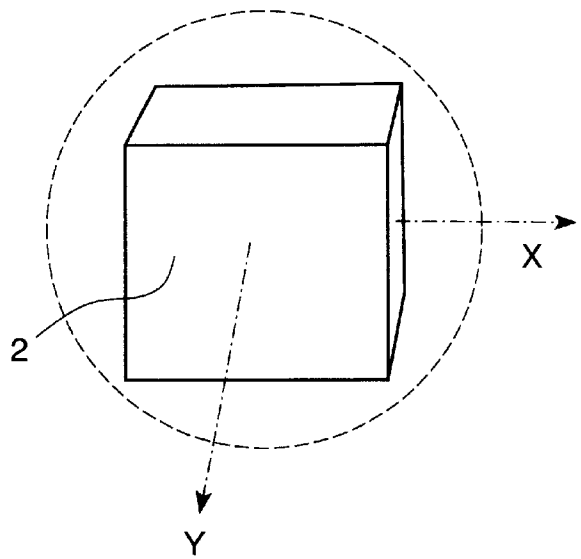
FIG. 5 illustrates the frame of reference axes of the accelerometer in the wand.
Figure 5:
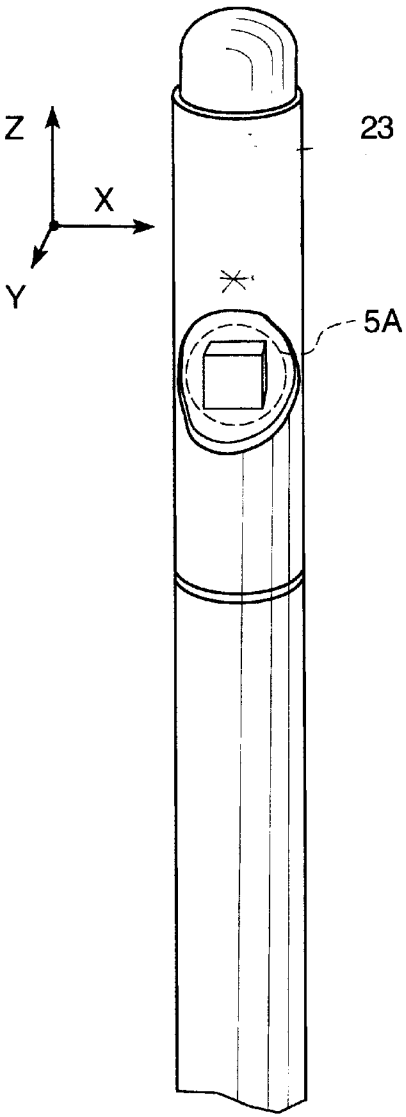

A 2-axis accelerometer (2) located near the tip end of the wand is used to provide motion input to the wand microprocessor (3). FIG. 5 shows the orientation of the accelerometer in the wand, and the orientation of the accelerometer's 2 sensing axes, X and Y. The accelerometer is oriented so that its inactive axis is in line with wand's longitudinal, Z, axis. The accelerometer's and wand's X axis is perpendicular to the Z axis, and is also perpendicular to the earth's vertical axis. The X axis also is usually aligned with the operator's axis of left-right direction. The accelerometer's Y axis is perpendicular to both the longitudinal (Z) axis of the wand and the X axis, and exits the wand near the "orienting indicator"(23) The operator's thumb is on the same "facing" edge of the wand as the "orienting indicator".

Accelerometers are actually force sensors; simultaneously measuring the force applied when an external agent moves the device, and that of gravity. The agent-applied force is the component required to "interpret" the operator's motions as specific instructions to the wand to select from its collection of Spells. Therefore acceleration information about the motion of the wand tip along the accelerometer's X or Y axes is obtained by subtracting out the (typical) gravitational force component from the total force signals provided by the accelerometer. This subtraction is accomplished by first storing, whenever the wand is steadied, a reference force value for each axis. When the wand is then moving, this "Steady Reference" pair of values is subtracted from the incoming force signals, thereby providing a useful measure of the wand tip's acceleration.

Before an operator performs a Spell, he steadies the wand at any orientation as in FIG. 1, with the one constraint that the subtle "orientation indicator"(23) on the case lines up with his thumb; a constant of orientation that relieves the microprocessor from having to work in a variable rotational frame of reference. When the wand is thus steadied for a short time (1–2 seconds), the microprocessor samples the gravitational force signals, computes and then stores in memory the gravitational "Steady Reference" values. The orientation of the wand during steadying is herein referred to as the "Steady Reference Point". After the Steady Reference values are computed, the wand is then ready for the operator to perform a Spell. Subtle accelerations can now be detected by the wand, whenever the wand is oriented near the Steady Reference Point.

Figure 2B:
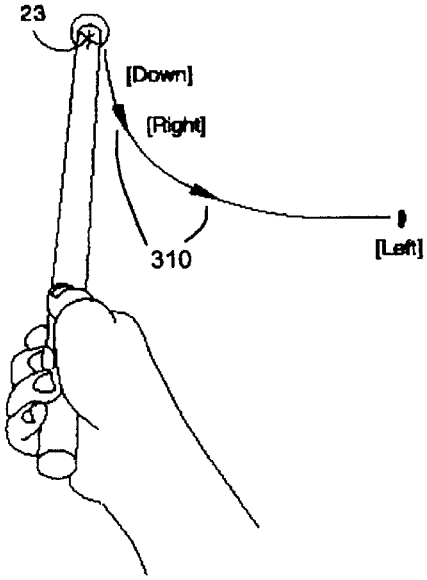
FIGS. 2A & 2B illustrate a method of operating the toy wand of FIG. 1.
Figure 2A:
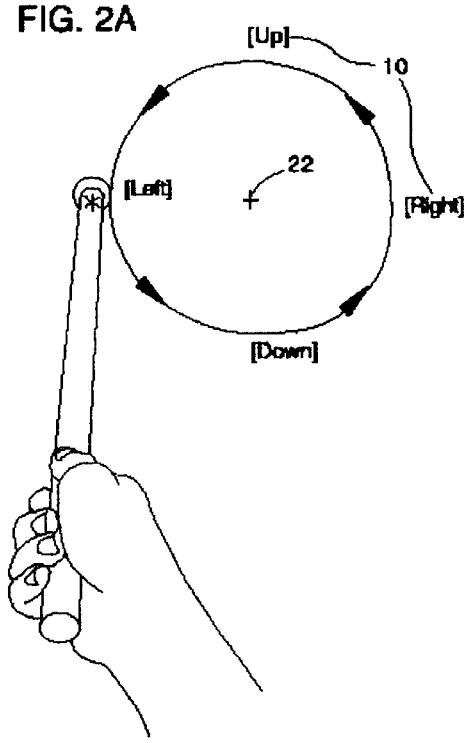

When the wand is moving, the microprocessor continually samples the force values from the accelerometer and subtracts the Steady Reference value from the sampled input values to produce an acceleration sample. The microprocessor then classifies said acceleration sample into one of a small group of quantized motion vectors (310), each vector defined by a direction component and a magnitude component. These motion vectors (310) are defined (notated) by a direction/magnitude pair, such as [Up,1] or [Left,3] or [Down,2]. (The terms for direction values "Down" and "Up" are only strictly accurate directional when the wand's Y axis is in line with the earth's vertical.) These motion vectors (310) are herein referred to as Classified Motion Vectors (CMV). Examples of the direction component(10) of the CMV for 2 motion sequences (paths) are shown in FIGS. 2*a* and 2*b*. The arrowed lines in FIG. 2 shows the path of movement, the bracketed value next to the line shows the resultant (net) acceleration direction; up, down, left or right. The Steady Reference Point (22) is shown in the center of the circle in FIG. 2*a*. The preferred embodiment uses 4 directions and 4 magnitudes, yielding a total of 16 possible CMVs, shown in Table 1.

TABLE 1 Possible CMV Values for Preferred Embodiment

| | | | |
|---|---|---|---|
| [Up,1] | [Up,2] | [Up,3] | [Up,4] |
| [Dn,1] | [Dn,2] | [Dn,3] | [Dn,4] |
| [Lf,1] | [Lf,2] | [Lf,3] | [Lf,4] |
| [Rt,1] | [Rt,2] | [Rt,3] | [Rt,4] |

Each time the CMV changes to a new value, the new CMV is buffered in a list (Motion History Buffer) that stores recent CMVs. The Spell Decode section of the microprocessor's program (FIG. 4) then compares the string of recent CMVs against a pre-stored list (Spell Sequence Library) of allowable Spell sequences and determines if a close-enough sequence has been performed to declare a Spell "Match". The Spell Decode and Match method is in all respects similar to well established art in the field of sequential pattern matching and recognition.

When a specific sequence of motion vectors (310) has been matched to one of a stored list of motion vectors, a "Spell" will have been considered successfully performed, and the microprocessor's program will then proceed into the Display mode part of its program. For each Spell that may be matched, there is a corresponding, unique Light Display, linked to it, and the type of display may be either "Simple" or "Interactive."

If the linked display is a "Simple" display, the microprocessor program (320) will proceed, upon entering the display program section, to set up loop counters and timers in order to turn each LED on and off according to a predetermined timing pattern. Techniques for patterned light displays, controlled by a program, are a well-established art, and no novel techniques are here added. The display continues its light pattern until the wand is steadied, or until a predetermined time period has elapsed.

Figure 6:
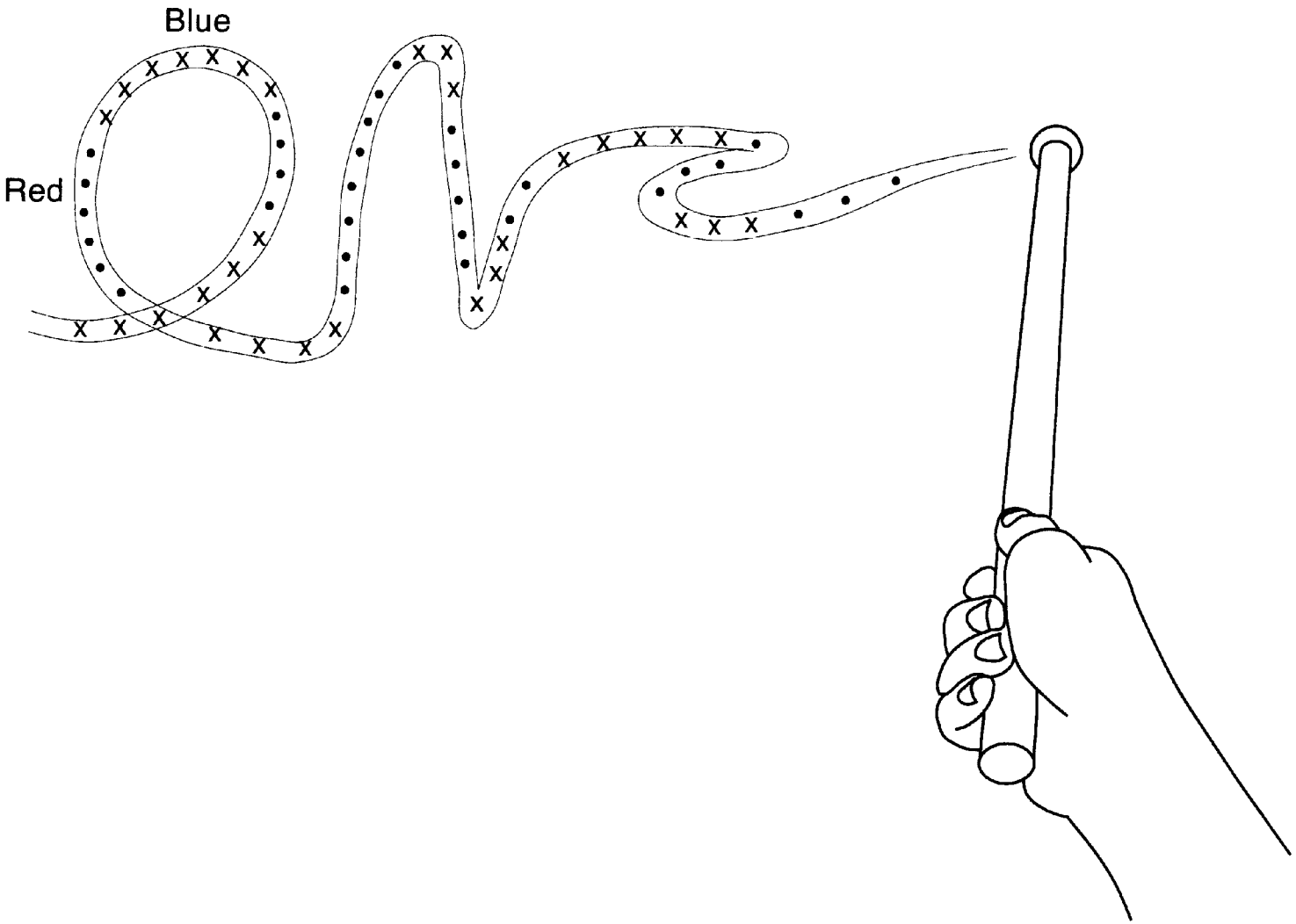
FIG. 6 illustrates an Interactive Display

If the linked Display is an "Interactive" display the microprocessor program (320) will proceed, upon entering the display program, to turn the LEDs on and off as a function of subsequent motion samples, this function being predefined in the program. For example, whenever the CMV direction value is "Up" or "Down" turn on the blue LED (5), and whenever the CMV is "Left" or "Right", turn on the red LED(5) (FIG. 6). When in the Display mode, the microprocessor continues looping through the "Input" and "Classify" processes (FIG. 4), providing new motion information to the Display process. Interactive displays cease when the wand is steadied.

The Inactive Wand

There are four modes that the wand can be operating in. The "Spell Decode" mode and the "Display" mode have already been discussed in the Active Wand discussion. The other 2 modes are "Steady", and "Sleep".

When the wand is steadied, the microprocessor enters Steady Mode, the qualitative physical property "Steady" is quantitatively determined by the program by means of comparing the inputted acceleration magnitude to a "Steady Threshold", a constant pre-determined in the program. If the magnitude is less than the Steady Threshold for a number of input samples equal to about 1 second of time, then Steady mode has been entered.

When the program is in the Steady mode, it performs the follow functions: The microprocessor program (320) generates a "Steady Reference" value for use in the Input process. The program resets the CMV motion history buffer to allow new spells to be recognized. The program provides a "Steady-Ready" blink to indicate to the operator that the wand is ready for a Spell.

If the wand is set down or held steady for a long period, then the program moves to the "Sleep" mode and powers down for low battery drain. After a long sleep period, preferably 20–90 seconds, the microprocessor wakes and moves to "Steady" mode to accept motion input.

Examples of Wand Operation

Example 1

The wand operator holds the wand, with the orienting indicator (23) upwards, as in FIG. 1, and steadies the wand for a short period. The operator then moves the tip of the wand in a circular clockwise motion (FIG. 2*a*). This motion will produce a sequence of Classified Motion Vectors (10). If this sequence has been performed accurately and in a timely manner, then the wand will have interpreted this as having completed a specific spell, Spell_A, for example. The wand will then start a lights display, in this example it will be a Interactive Display, which is specific for Spell_A. In this example, the wand will produce a very short white LED blink(202) every time the CMV value changes direction. The Wand will continue in this Interactive Display until the operator steadies the Wand. The light display will then cease, and the operator is able to perform a new spell, if he or she so desires.

Example 2

In a second example, the operator, after steadying the wand, performs a new sequence of motions (FIG. 2*b*), consisting of a motion to the down, followed by a motion to the operator's right. Upon recognizing this Spell_B, the wand enters a "Simple" display (not Interactive), which rapidly blinks all of the LED lights in a random fashion, for a sparkler effect. The display is unaffected by any motion of the Wand, and turns off by itself after a fixed period.

Example 3

In a third example, the operator will perform a clockwise motion similar to Example 1, but moving in a quicker manner. Because of the stronger acceleration, the wand will decode this motion as Spell_C, and a different display will be initiated.

After the wand has been in its resting mode for a while, it moves to sleep mode to conserve electricity. The wand will then wake up after a period and stay awake if there is motion of the wand.

Detailed Description of Block Diagram, FIG. 3

The BATTERY supplies current directly to the MicroProcessor. The current to the Motion Detector and LED lights is controlled(supplied) by the MicroProcessor.

The MOTION DETECTOR, such as an accelerometer, supplies motion information to the MicroProcessor.

A typical motion detector is a 2 axis accelerometer. Inertial rolling ball (302) and spring assemblies(303) that react to gravity or acceleration due to change in motion or tilt are also useful motion detectors for the purpose of this Wand invention. Also, air speed sensors(304) are useful motion detectors for purposes of this invention.

In the preferred embodiment, the motion detector is a single chip integrated circuit (2)device such as the ADXL202.

THE MICROPROCESSOR executes a program, which encodes, interprets, classifies, stores in memory, and controls all the activity of the Wand. For purposes of this invention, most general purpose small, single chip microprocessors are suitable.

The microprocessor requires an internal stored program memory, general purpose memory, ports suitable for interfacing to motion sensors and LED lights, a power down mode, and enough speed to process many hundreds of motion samples per second. The clock for the microprocessor may be internal to the microprocessor part, or externally supplied.

Figure 4:
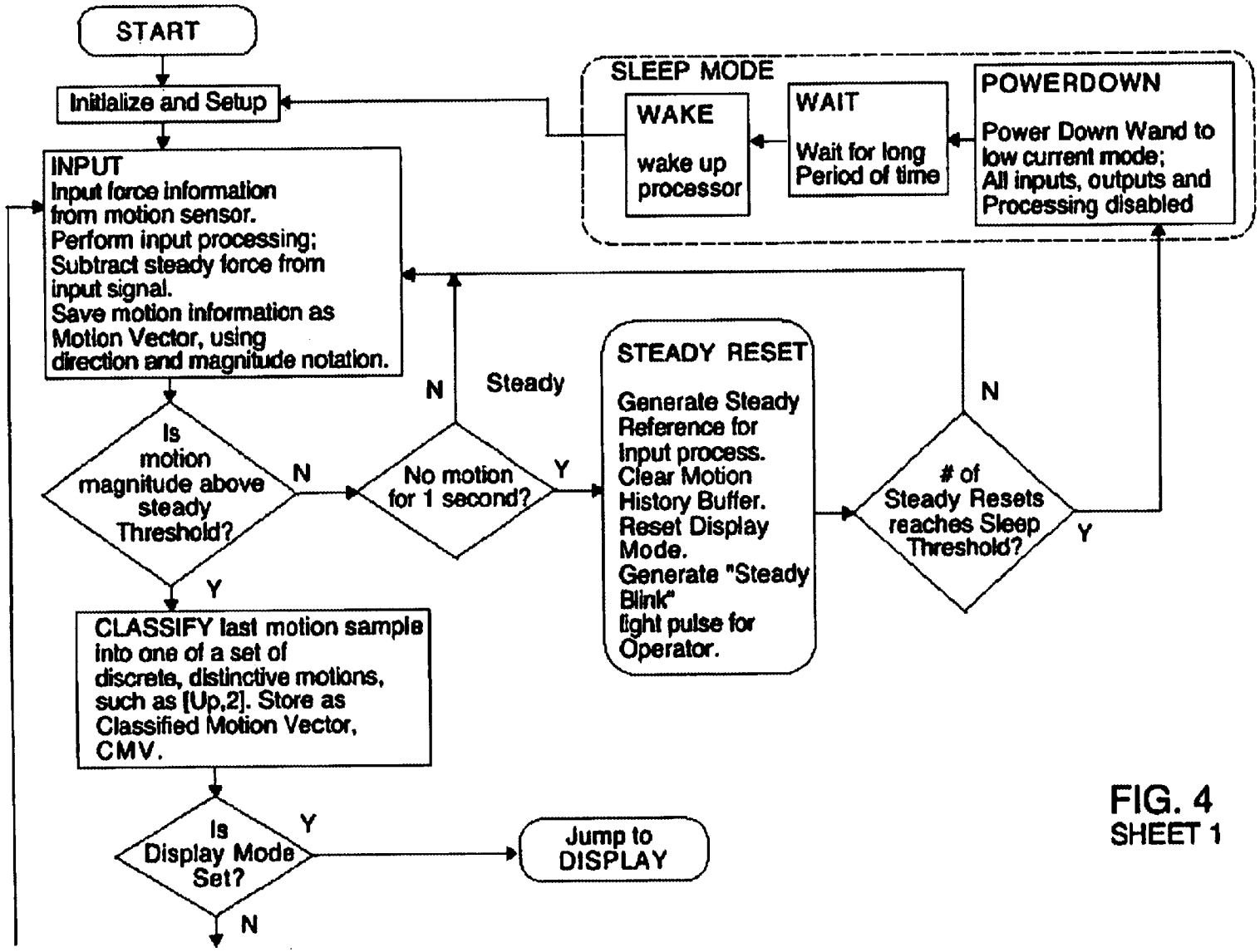
FIG. 4 is flow chart example of a microprocessor program, controlling operation of the toy wand of FIG. 1
Figure 4:
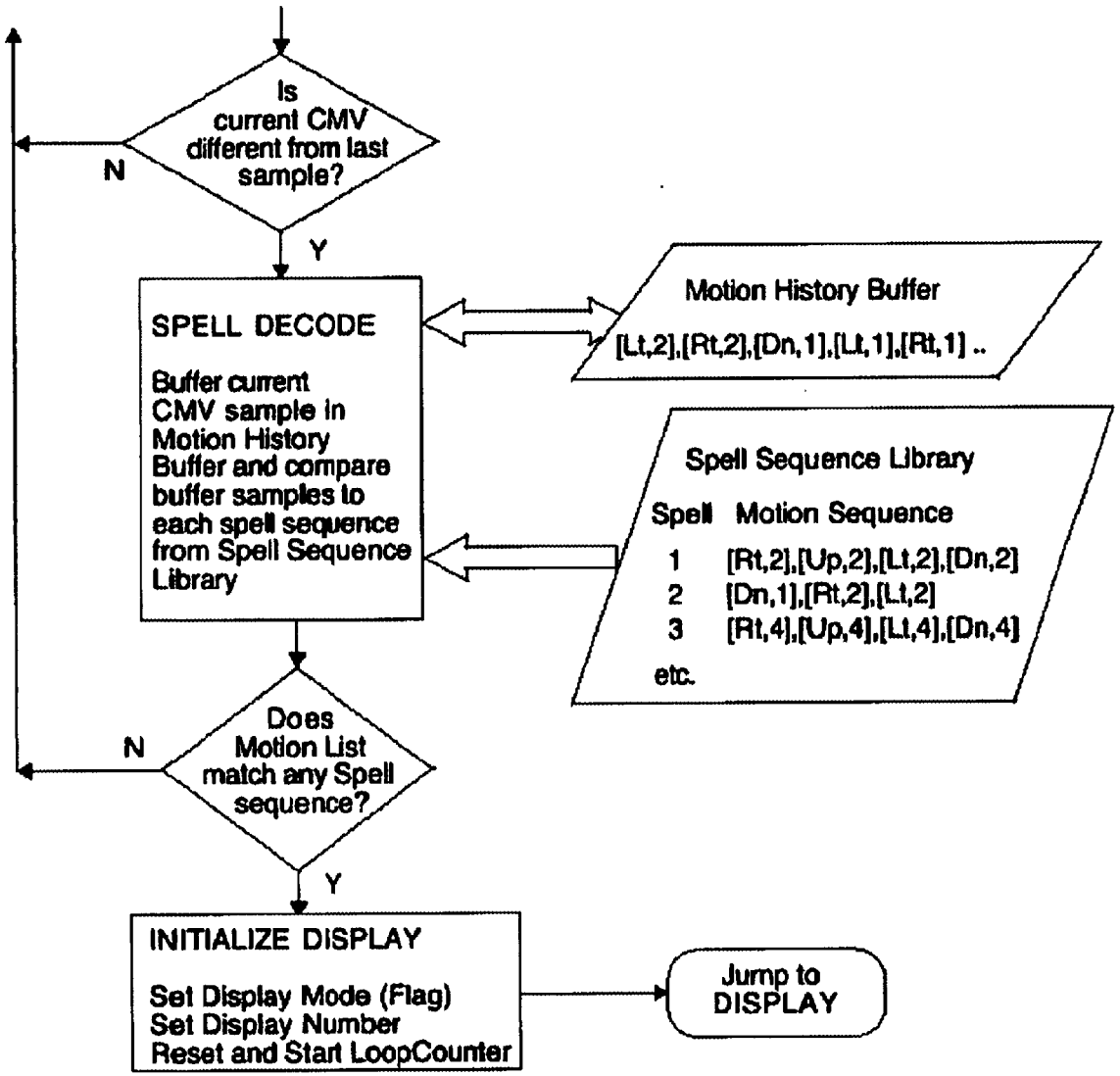
Figure 4:
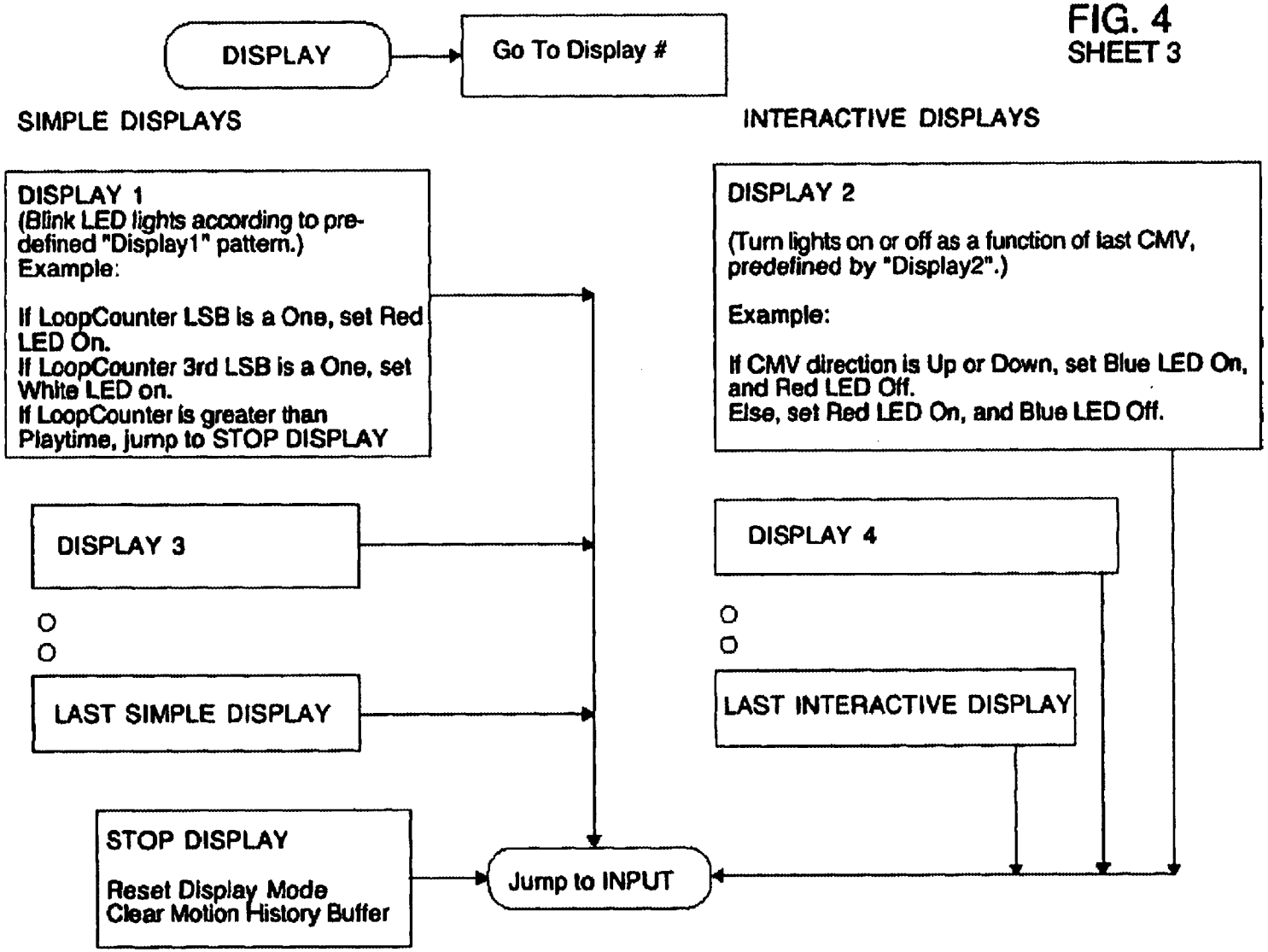

AN EXAMPLE of a MicroProcessor program, for the preferred embodiment, is shown in the flow chart of FIG. 4. The major paths through the flow chart are demonstrated.

The program first starts execution when the MicroProcessor is first electrically connected to the battery or when the micro is internally woken up, and continues looping through the processes indefinitely, when not in SLEEP MODE.

The INPUT process accepts a sample of motion information from the motion sensor input, and processes that motion sample for later use.

If a sample's acceleration magnitude, is above a low "Quiet" threshold, then the program moves on to the CLASSIFY process which classifies the motion into one of a set of distinct, quantized motions (CMVs).

If Display Mode is not set, the program determines if the current CMV is different from the last sample. If it is different, the CMV is stored in the Motion History Buffer and the program then moves to the SPELL DECODE process, which attempts to match the motions in the history buffer to a specific Spell's sequence of motions, as stored in the library of Spell sequences.

If a match with a specific Spell is found, then the programs move to a DISPLAY process that produces a specific light pattern for the matched Spell.

If the matched Spell has a Simple Display associated with it, the program will start a timer, and before the timer has "timed out", will display a fixed pattern of blinking lights.

If the matched Spell was linked to an Interactive Display, the program will continue processing and interpreting motion samples while in the display mode, and use the motion samples to affect the lights display. This display will continue as long as the Wand is being actively moved.

Alternate Pathways and Processes

If the motion magnitude is "Quiet", then the program enters a STEADY MODE and, eventually (after a moderate period) SLEEP MODE and looping is discontinued.

After a long period of sleep, the main loop process is re-started at the "Initialize and Setup" process.

The program can be viewed as always operating in one of four MODES:

In the DECODE MODE, while decoding, the program loops through the Input Process, the Classify Process, the Spell Decode Process, and then back to the Input Process.

In the DISPLAY MODE, the program loops through the Input Process, the Classify Process, the Display Process, and then back to the Input Process.

In the STEADY MODE, the program loops through the Input Process, the Steady Reset Process, and the back to the Input Process.

In the SLEEP MODE, the program moves to the Power-Down Process, then the Wait Process, followed by the Wake Process.

The COLORED LIGHTS, such as LEDs, are connected to and controlled by the MicroProcessor. The LED (or other) light sources, required to be very bright and of unusual colors, are mounted internally and are optically adjacent to the EndCap.

The ENDCAP, made of such as acrylic plastic, glass, or crystal, and mounted at the end of the wand, may be constructed or surfaced in such a manner to alter the path of the direct light by diffusion or refraction.

OTHER EMBODIMENTS

Second Embodiment

Position/Orientation Sensing

A second embodiment of the wand uses position or orientation sensing, as well as or in place of motion sensing.

Because of the force of gravity, accelerometers can be used to sense position/orientation, or more accurately, tilt angle—the difference in angle between the accelerometers axis of operation and the direction to the center of the earth. The effect of the force of gravity on the accelerometer therefore varies with the tilt angle, and this force was subtracted from the accelerometer input in the preferred embodiment in order to find the true acceleration of the tip.

In this second embodiment, position/orientation, as defined by the resultant force of gravity on each accelerometer axis, is used sequentially as the determinant in defining and performing a Spell. In this embodiment a spell is performed by moving the wand to a series of pre-determined positions/orientations.

A quantized position/orientation co-ordinate pair is used to make a classified position/orientation indicator, similar to the Classified Motion Vector in the preferred embodiment.

Further the positional/orientational inputs can be used to modify displays. For example, the frequency of blinking LED lights can be changed depending on how the wand is oriented/positioned.

Third Embodiment

Additional Sources of Input

Additional inputs, in conjunction with motion and position sensing, provide an exciting and novel array of modes for the wand to respond to. Some examples of means for providing additional electronic inputs include:

MAGNETIC SENSORS for use in a compass spell or display.

LIGHT SENSORS for use in detecting other light sources, and for use in determining day from night.

TEMPERATURE SENSORS give the Wand information about seasonal and indoor/outdoor use.

The additional sensors can have an effect during almost any phase of the Wand's operation.

A magnetic sensor (305), for example can be used during a Display to cause a light to blink only when the wand is pointing North.

A light sensor (306) can be used, for example, to cause a longer period of Sleep during the daylight hours than at night. Also, blinking light from another source can be sensed and cause the wand to jump directly into a blinking Display.

A temperature sensor (307) can, for example, cause the wand to inhibit some Spells during certain seasons or weather conditions, and cause other Spells and Displays to be enabled.

The lights need not be only internal to the case, but may be external or otherwise mounted.

The accelerometer may be measuring along one, two,or three axes.

The microprocessor may be any electronic device capable of performing the described processes.

The motion detector may be any device capable of detecting the velocity, acceleration, position or orientation of the wand.

What is claimed is:

1. A toy wand for operation by a human comprising:

an elongated casing having a first end and a second end;

a motion detector for detecting motion of said wand;

a means for emitting a human-detectable response;

a microprocessor operably connecting said motion detector and said means for emitting, said microprocessor including:

a first library of target motion sequences;

a motion history buffer for recording a history of said motion extending up to the present;

comparison means for repeatedly comparing said history of said motion with said target motion sequences;

activation means for activating said means for emitting when said comparison means detects a match between said history of said motion extending up to the present and one of said target motion sequences.

2. The toy wand of claim 1 wherein said microprocessor further includes a second library of emitting displays, each of said emitting displays corresponding to one of said target motion sequences, and wherein said activation means activates said means for emitting as per one of said emitting displays, each of said emitting displays corresponding to said one of said target motion sequences.

3. The toy wand of claim 2 wherein said means for emitting is multi-colored light-emitting-diode lights.

4. The toy wand of claim 2 wherein a subset of said library of emitting displays control said emitting means as a function of motion.

5. The toy wand of claim 2 wherein a subset of said emitting displays control said emitting means as a function of time.

6. The toy wand of claim 2 further including a battery for powering said wand and a means whereby said microprocessor determines an absence of said wand motion, said absence causing said wand to enter a battery-conserving mode of operation.

7. The toy wand of claim 2 further including other detectors than said motion detector, said other detectors selected from the group consisting of magnetic, light, and temperature detectors, wherein said other detectors modify said activation means and said emitting displays.

8. The toy wand of claim 1 wherein said motion detector is an accelerometer, said accelerometer mounted to detect acceleration of said first end of said toy wand.

9. A toy wand for operation by a human comprising:

an elongated casing having a first end and a second end;

an orientation detector for detecting orientation of said wand, where said orientation of said wand is defined as the static angular position of the longitudinal axis of said wand with reference to the center of the earth;

a means for emitting a human-detectable response;

a microprocessor operably connecting said orientation detector and said means for emitting, said microprocessor including:

a first library of target orientation sequences;

an orientation history buffer for recording a history of said orientation extending up to the present;

comparison means for repeatedly comparing said history of said orientation with said target motion sequences;

activation means for activating said means for emitting when said comparison means detects a match between said history of said orientation extending up to the present and one of said target orientation sequences.

10. The toy wand of claim 9 wherein said microprocessor further includes a second library of emitting displays, each of said emitting displays corresponding to one of said target orientation sequences, and wherein said activation means activates said means for emitting as per one of said emitting displays, each of said emitting displays corresponding to said one of said target orientation sequences.

11. The toy wand of claim 10 wherein said means for emitting is multi-colored light-emitting-diode lights.

12. The toy wand of claim 10 wherein a subset of said emitting displays control said emitting means as a function of orientation.

13. The toy wand of claim 10 wherein a subset of said emitting displays control said emitting means as a function of time.

14. The toy wand of claim 10 further including other detectors than said orientation detector, said other detectors selected from the group consisting of magnetic, light, and temperature detectors, wherein said other detectors modify said activation means and said emitting displays.

15. The toy wand of claim 9 wherein said orientation detector is an accelerometer, said accelerometer mounted to detect orientation of static angular position of the longitudinal axis of said wand with reference to the center of the earth.

* * * * *